United States Patent [19]

Jacobs

[11] 4,091,857

[45] May 30, 1078

[54] CABLE-SUSPENDED DRAW-CURTAIN SYSTEM

[75] Inventor: Lawrence O'Quinn Jacobs, Richmond, Va.

[73] Assignee: Plastic Products, Inc., Richmond, Va.

[21] Appl. No.: 812,889

[22] Filed: Jul. 5, 1977

[51] Int. Cl.[2] ..... A47H 1/19

[52] U.S. Cl. ..... 160/330; 211/119.12; 211/46; 49/148

[58] Field of Search ..... 160/330, 350; 49/147, 49/148; 211/119.12, 119.06, 119.13, 119.14, 1.3

[56] References Cited

U.S. PATENT DOCUMENTS

| | | | |
|---|---|---|---|
| 1,521,987 | 1/1925 | Belfranci | 211/119.12 |
| 3,481,073 | 12/1969 | Yoshida et al. | 160/84 R |

FOREIGN PATENT DOCUMENTS

| | | | |
|---|---|---|---|
| 678,117 | 3/1966 | Belgium | 160/330 |
| H22,091 | 6/1956 | Germany | 160/330 |

*Primary Examiner*—Kenneth Downey
*Attorney, Agent, or Firm*—Norman B. Rainer

[57] ABSTRACT

A system is provided whereby a flexible curtain is hunt from a horizontal span of an overhead suspended cable, and can be drawn off said cable onto a rigid track for storage. The track is positioned contiguous to an end of said span and above said cable. Transfer of the curtain from the cable to the track is facilitated by use of an inclined member which smoothly engages both said cable and said track, causing said transfer to occur within said horizontal span. Traversal of the curtain with respect to the cable is achieved by means of carriers equipped with wheels which ride atop said cable.

6 Claims, 8 Drawing Figures

CABLE-SUSPENDED DRAW-CURTAIN SYSTEM

BACKGROUND OF THE INVENTION

This invention relates to a horizontally drawable curtain, and more particularly to an improved system for deploying a horizontally drawable curtain on an overhead suspended cable.

Large foldable curtains fabricated of film, fabric, netting, or other flexible structures find use in various applications. They may be employed for the purpose of controllably obscuring objects or areas, such as when used as stage curtains or curtains for concealment of projector screens or exclusion of light. Such curtains, which may extend from ceiling to floor, may also be employed for decoration, acoustic insulation, fire protection, air flow restraint, and space dividing as when used to divide large indoor or semi-indoor areas such as gymnasiums, meeting halls and arenas into smaller separated areas.

In use, the curtain is generally suspended from its upper edge by hooks which engage with an overhead support means such as a rigid track attached to a ceiling or ceiling support beam. Means are usually provided to enable the curtain to be drawn in a horizontal direction in a manner such that the hooks traverse the track by sliding or rolling engagement therewith. From its fully deployed functional state, the curtain is thereby generally drawn horizontally to a stored state consisting of a gathered or compacted array of vertical folds, and positioned under one or both ends of the track. In such mode of disposition, the stored curtain occludes a small but finite fraction of the total expanse spanned by the track and occluded by the curtain in its fully deployed state. In re-deploying the curtain, the direction of traversing movement is merely reversed, and the curtain is transferred from its stored position to its fully extended, deployed state.

In certain situations however, there is no structural ceiling available for the mounting of a track device. Such instances prevail for example in the case of large auditoriums or field houses where the ceiling is extremely high compared to the desired height of the curtain, or in inflated buildings having a fabric ceiling maintained taut solely by air pressure, or in buildings or portions thereof having no ceiling.

It is known that curtains or other sheet structures may be hung in fixed stationary, clothesline fashion from an overhead cable suspended from two points of support. Such cables, however, which may for example bridge two walls in a ceiling-less building, are not generally utilized to support a traversing curtain. In those special instances wherein a cable is in fact utilized to support a horizontally drawn curtain, difficulties are encountered when it is desired to have the distance spanned by the cable completely free of suspended curtain when said curtain is in the stored state. This is a particularly desirable accomplishment because one advantage of using a cable to suspend a horizontally drawn curtain is that, once the curtain is transferred from the cable to its stored state, the cable can be removed, thereby eliminating any trace of the curtain system. Such manner of utilization is of value for the purpose of achieving an uncluttered appearance within a building, and in eliminating any obstructions above the normal height of the curtain.

It is accordingly an object of the present invention to provide a system wherein a horizontally drawn curtain is supported by an overhead suspended cable. It is another object to provide a horizontally drawn curtain system wherein a flexible curtain may be deployed in its extended state while supported by an overhead suspended cable and said curtain can be made to traverse horizontally to a stored state. It is a still further object of this invention to provide a curtain installation wherein a flexible curtain is deployable in its extended functional state while supported by an overhead suspended cable, and said curtain can be made to traverse horizontally to a stored state where it no longer engages said cable. These objects and other objects and advantages of the invention will be apparent from the following description.

SUMMARY OF THE INVENTION

The objects of the present invention are accomplished in general by providing a system of apparatus and its arrangement involving the use of a cable removeably anchored at one end and having tensioning means at its opposite end, and arranged so that a portion thereof is disposed as a horizontally oriented span. An aligned plurality of carriers engage the upper portion of said cable for traversing movement with respect thereto. A flexible curtain having a straight upper edge is pendantly supported by said edge held at spaced points by portions of said carriers disposed below said cable. An inclined transfer means is positioned above said cable at that extreme of said horizontal span closest to said tensioning means, the lower terminus of said transfer means being directed toward the anchored end and adapted to transversely straddle said cable, the upper terminus of said transfer means engaging with the forward end of a rigid track initially coextensive with said cable. The combined disposition of said transfer means and the forward end of said track is adapted to provide a continuous structural path which leads out of the vertical plane containing the cable in a transition region located above said horizontal span and prior to the end of said span closest to said tensioning means.

In embodiments of the system wherein the horizontal span is greater than about 50 feet, one or more telescoping support posts may be employed which, at their upper extremity, supportively engage the cable, and at their lower extremity rest on the floor. Said posts are constructed in a manner such that, when removal of the curtain is desired, the posts will ride along with the curtain to the storage mode suspended by a carrier of the type which supports the curtain.

BRIEF DESCRIPTION OF THE DRAWING

In the accompanying drawing forming a part of this specification and in which similar numerals of reference indicate corresponding parts in all the figures of the drawing.

DETAILED DESCRIPTION OF THE INVENTION

Figure 1:
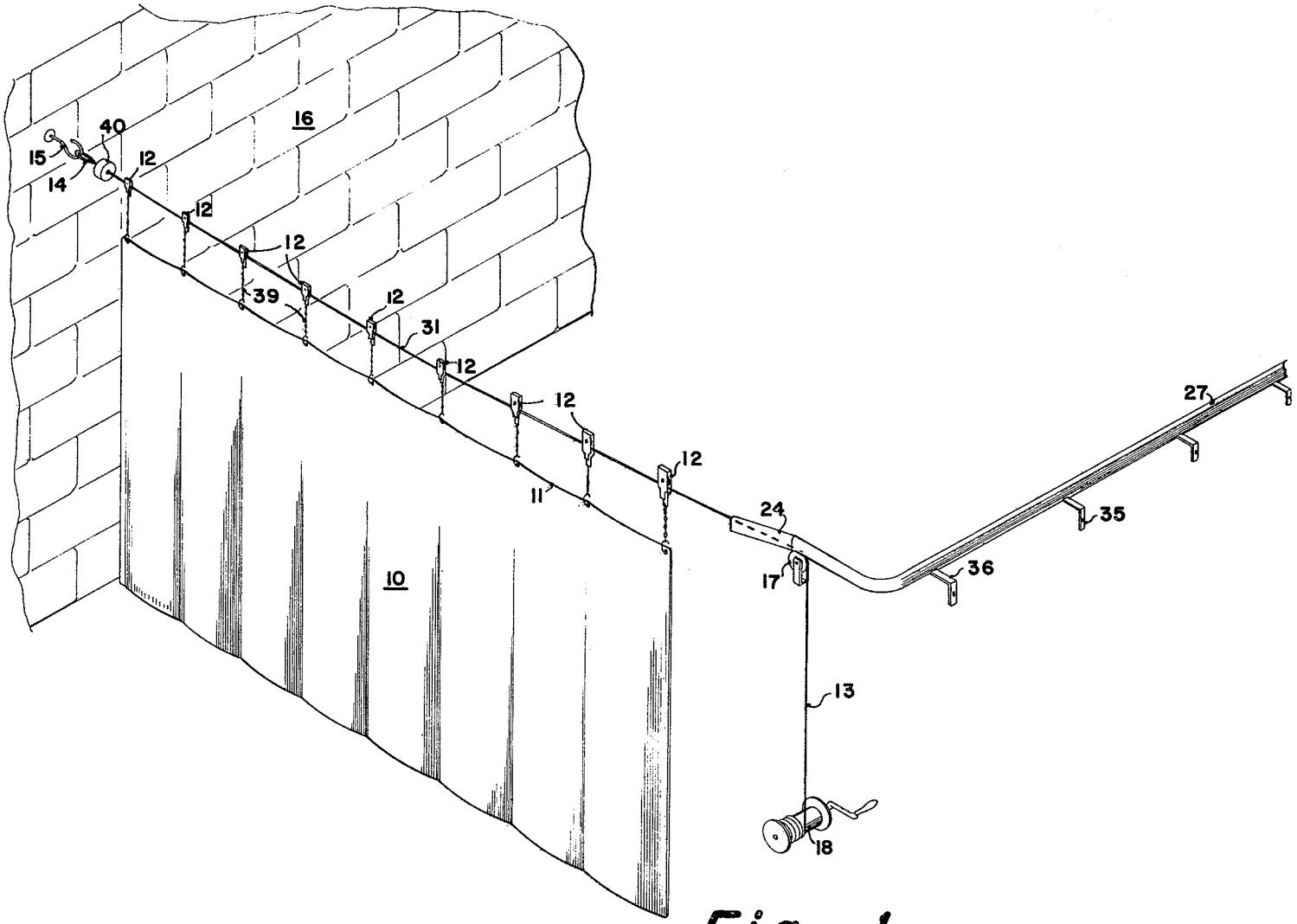
FIG. 1 is a perspective view of a curtain system of the present invention with the curtain in its deployed state.

Referring to FIG. 1, a flexible curtain 10 is attached at its upper edge 11 via chains 39 to a plurality of carriers 12 which engage with the horizontally disposed span 31 of cable 13. One end of cable 13 contains loop 14 which engages with anchoring means 15 associated with wall 16. A guide means embodied as pulley wheel 17 located at the extreme of the horizontally disposed span 31 opposite said anchored end enables the cable to be redirected away from its horizontal path toward winch 18 with which it engages.

Manual or motor driven means may be provided for rotating winch 18 in a manner such that very high tension can be applied to the cable. Although the portion of cable 13 extending between anchoring means 15 and guide means 17 is referred to herein as being "horizontally disposed", in actual practice, the cable will not lie in a perfectly straight line but will instead conform to a catenary curve. The extent of deviation of said horizontally disposed span from a straight line will depend upon the tension applied to the cable, the weight of the curtain structure suspended therefrom, and the length of the horizontal span. In certain embodiments, removeable posts may be utilized to further support the suspended cable.

The guide means 17, although exemplified as a vertically disposed pulley wheel in FIG. 1, may be oriented in directions other than vertical, and may in fact be a stationary bearing surface having low-friction characteristics. The function of the guide means is to support one end of the horizontal span of cable 13. Suitable bearing surfaces for use as a guide means may be fabricated of specially hardened metal alloy or ceramics as generally known in the art. The winch 18 may be positioned in any direction with respect to guide means 17. Although a position below the guide means is convenient, a position at an elevation comparable to the guide means has the advantage of being less conspicuous and less likely to interfere with activities at ground level.

Figure 4:
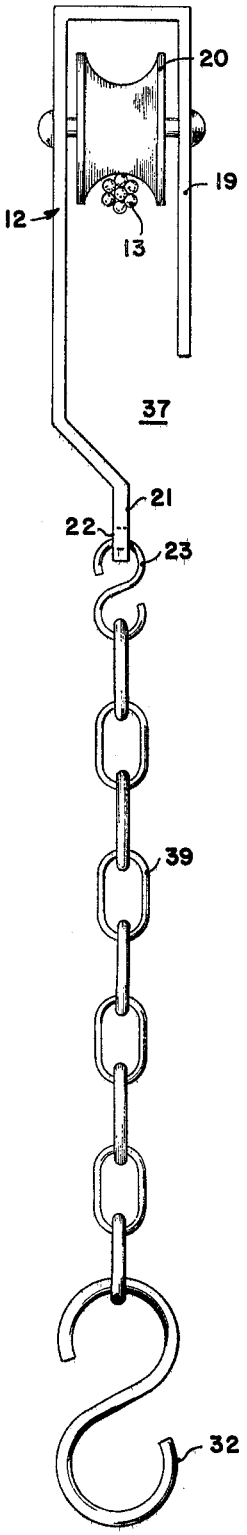
FIGS. 4, 4A and 4B are vertically transverse sectional views of a curtain carrier of FIG. 1 positioned on the cable, on the transfer means, and on the track respectively.

Each carrier 12, as shown in FIG. 4, is comprised of an upper yoke portion 19 which retains grooved wheel 20 for rotation in a vertical plane. Said wheel may be fabricated of metal or plastic and has a diameter ranging from about 1 to 4 inches. An opening 37 is provided on one side of the carrier below the yoke portion. A leg portion 21 integral with said yoke portion as a continuous extension thereof is positioned below said yoke portion and generally aligned with the center of the groove of wheel 20.An aperture 22 in leg portion 21 is provided to accommodate upper S-hook 23 for engagement with a chain 39 containing lower S-hook 32 which engages with grommets along the upper edge of said curtain. The height of the upper edge of the curtain may be adjusted by insertion of lower S-hook 32 into the appropriate link of chain 39 so that, even though cable 13 conforms to a catenary curve, the upper edge of the curtain may be a substantially straight line.

Figure 3:
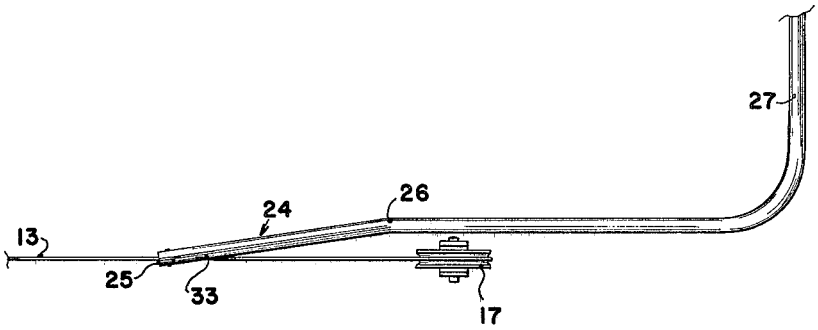
FIG. 3 is a top view of the portion of the system shown in FIG. 2.
Figure 2:
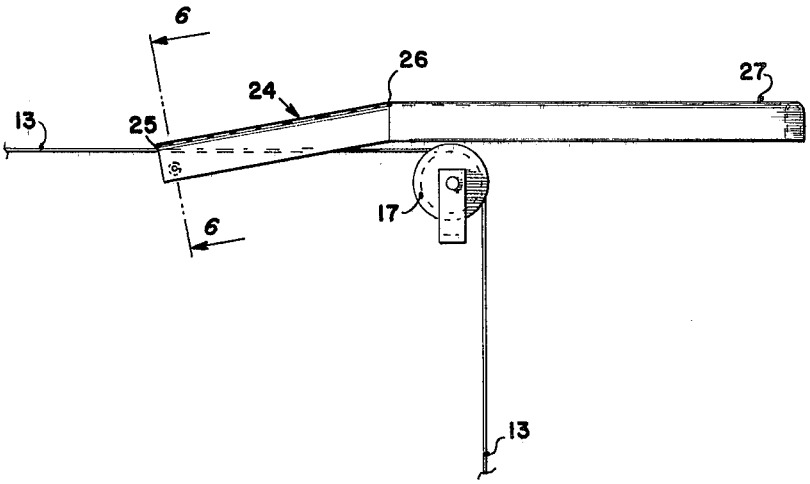
FIG. 2 is an enlarged fragmentary side view of the portion of the system of FIG. 1 where the cable meets the track.

As shown in FIGS. 1, 2 and 3, an inclined transfer means embodied as saddle member 24 is positioned above cable 13 at that end of the horizontal span 31 adjacent guide means 17. The exemplified embodiment of the saddle member is a straight rigid elongated structure disposed at an angled relationship with respect to said cable. The lowermost end 25 of saddle member 24 straddles the cable, and uppermost end 26 engages with a track member 27 positioned at an elevation higher than said cable and higher than guide means 17.

Figure 6:
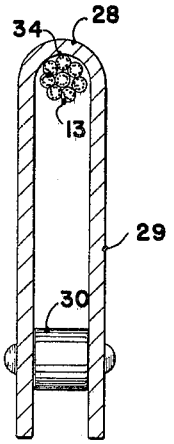
FIG. 6 is a sectional view taken along the line 6—6 of FIG. 2.

As shown in FIG. 6, the uppermost or bearing edge 28 of saddle member 24 has a rounded contour. A bifurcated downwardly opening U-shaped portion 29 serves to accommodate cable 13. Retaining means 30, which may be a stationary member or rotatable wheel, functions to confine cable 13 within the upper region of bifurcated portion 29.

The acute angle formed by the intersection of a tangential extension of bearing edge 28 with the cable 13 is about 10° in the embodiment shown in FIG. 2. In general, said angle may have values in the range of 2° to 15°. The transverse thickness of bifurcated portion 29 and the radius of curvature of bearing edge 28 are chosen so as to accommodate the curved groove of the wheels 20 of carriers 12.

Figure 4A:
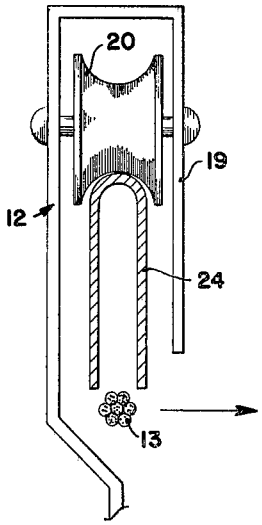
Figure 4B:
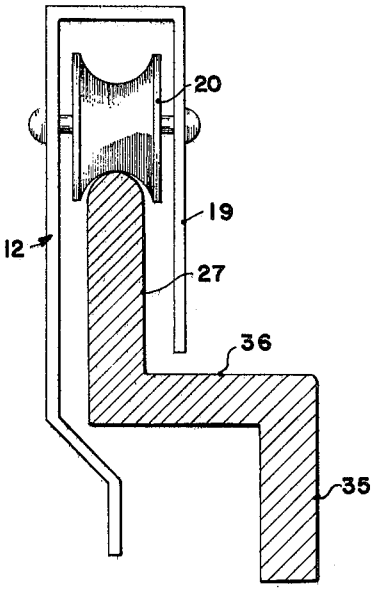

In operation, the curtain 10 supported by carriers 12 may be drawn from its deployed state to a stored state and vice versa by manually pulling on the appropriate extreme of the curtain. In some embodiments, a line may be attached to either extreme carrier to facilitate pulling of the curtain. As the carriers approach the transfer means 24 the disposition of the cable with respect to wheel 20 is as shown in FIG. 4. When the carrier rides up the transfer means and is at the transition region 33 indicated in FIG. 3, the disposition of the cable is as shown in FIG. 4A where it is to be noted that the carrier has been displaced upwardly to the level of its opening 37. By virtue of the angled path of saddle member 24, the cable 13 exits sideways from the carrier, as shown by the arrow in FIG. 4A. It should be noted that the transfer of the carrier from saddle member 24 to track member 27, and the exit of the cable from the carrier occur before guide means 17.

The location of transition region 33 is critical because, at this region, where the carriers depart from the plane of the cable, the carrier must be displaced upwardly a sufficient distance to permit the emergence of said cable from opening 37. Said transition region may occur either on the transfer means, as exemplified in the drawings, or on the initial portion of the track. In said latter situation the transfer means would be aligned within the plane of the cable, and the forward portion of the track would be initially coextensive with said transfer means at their juncture and would then curve or angle away from the cable.

It should be noted that, whereas the suspended cable 13 must of necessity follow a path within a vertical plane, the orientation of the storage track is not so restrained. The path of the track, although initially parallel to the cable, is not necessarily constrained to a single vertical and/or horizontal plane. The track will in fact generally transport the curtain to a position of storage, such as along a wall structure, which may be perpendicular to the deployed position. In the stored configuration, the curtain may be either gathered, or extended to its full length.

The pulling action during the storage process causes the grooved wheels 20 of carrier 12 to roll along the top of the cable in unison and ride up the saddle member onto the track, thereby effecting traversal of the curtain along said cable and transfer to track 27 for storage. In order to secure low frictional impedance during drawing, it is preferable that the gap between bearing edge 28 and the top of the cable be minimized. Toward this objective, said saddle may be fabricated as a troughshaped member from sheet metal having a thickness of 0.020 to 0.040 inches. In some embodiments, saddle 24 may be fabricated from bar stock in a manner such that the upper and lower ends are designed as prescribed herein. The upper interior region 34 of bifurcated portion 29 may be tapered so as to make a closer fit with the cable. The function of retaining means 30 in the lower end 25 of saddle 24 is to retain the cable within bifurcated portion 29 particularly when the cable is disconnected from its anchored end and reeled onto winch 18. The loop 14 or stopping member 40 impinges against said lower end 25, thereby terminating the reeling process. Upon redeploying the cable from its reeled state, difficulties would be encountered in threading the cable through bifurcated portion 29 were it not for the retaining action of retaining means 30.

The saddle member 24 may have a length ranging from about 10 to 30 inches, terminating in an uppermost end 26 adapted to smoothly engage with the forward terminus of track 27. The means by which the upper end of the saddle engages with the track preferably involves a downwardly opening U-shaped configuration which overlaps a portion of the top of the track and is riveted or otherwise joined thereto by attachment means which do not protrude from the joint area, thereby providing a smooth path for passage of the carriers.

The track member 27 has an upper bearing edge similar in dimensions and configuration to the bearing edge 28 of saddle member 24. The track member is designed to accommodate carriers 12 in a manner minimizing frictional effects. It is of rigid construction and is fixedly attached by means of flange 35 and standoff 36 to structural features of the building such as walls or appurtenances adjacent thereto not shown in FIG. 1 for purposes of clarity of illustration. Said flange and standoff may either occur at spaced intervals along said track or may be continuous as part of an integral extruded shaped structure. It is particularly noteworthy that said track may be unsupported by said standoff 36 at its forward end where it receives the carriers, particularly if transition region 33 occurs on said track.

The term "cable", as used herein, is intended to denote any strong flexible strand; generally a multifilamentary structure having a twisted or braided configuration. Suitable cables may be fabricated of steel wire, fiberglass, or high tenacity continuous filaments of synthetic polymeric material such as polyester or polyamide. The cable may be coated or jacketed with an adherent abrasion-resistant material. A particularly preferred cable is one of multifilament steel of ¼ inches cable diameter.

Figure 5:
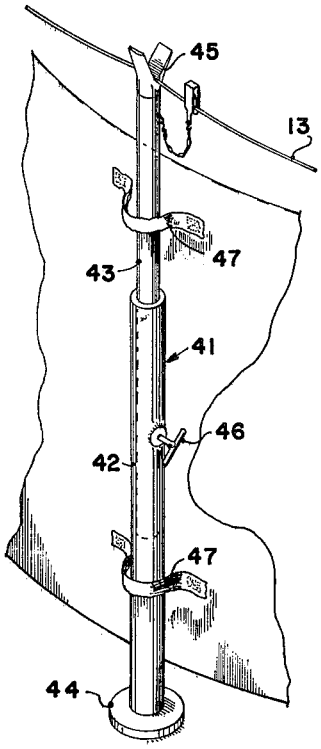
FIG. 5 is a front fragmentary view of a curtain of this invention provided with a telescoping support post.

Referring to FIG. 5, support post 41 is shown consisting of outer tubular member 42, close-fitting inner member 43, footing 44, and engaging notch 45. In use, the inner member is raised until notch 45 engages cable 13. At this position, spring-activated plunger rod 46 engages with a hole in inner member 43, thereby locking said inner member in place. Footing 44 is provided with a cushioned bottom adapted to prevent damage to the floor. When removal of the post is desired for storage, the plunger rod is pulled out and the inner member is caused to telescope further into outer tubular member 42, at which point plunger rod 46 engages with a suitably positioned hole in inner member 43 causing a shortening of the overall height of support post 41. In its shortened configuration, the post becomes pendantly supported by a carrier 12, and can be drawn along with the curtain. Strap members 47 may be utilized to stabilize the position of the post with respect to the curtain.

While particular examples of the present invention have been shown and described, it is apparent that changes and modifications may be made herein without departing from the invention in its broadest aspects. The aim of the appended claims, therefore, is to cover all such changes and modifications as fall within the true spirit and scope of the invention.

Having thus described my invention, what is claimed is:

1. A horizontally traversable curtain system comprising a tensioned cable removeably anchored at one end and having tensioning means at its opposite end, and arranged so that a portion thereof is disposed as a horizontally oriented span between said anchored end and a guide means which redirects said cable to said tensioning means, an aligned plurality of carriers engaging the upper portion of said cable for traversing movement with respect thereto, a flexible curtain having a straight upper edge and pendantly supported by said edge held at spaced points by attachment to portions of said carriers disposed below said cable, an inclined transfer means positioned above said cable at that extreme of said horizontal span adjacent said guide means, the lower terminus of said transfer means being directed toward said anchored end and adapted to transversely straddle said cable, the upper terminus of said transfer means engaging with the forward end of a rigid storage track which is initially coextensive with said cable, the disposition and interaction of said transfer means and said storage track being such as to provide a transition region wherein said carriers disengage from said cable, said transition region being located above said horizontal span and between the lower terminus of said transfer means and said guide means whereby said carriers are transferred from said cable onto said storage track.

2. The curtain system of claim 1 wherein said carriers are comprised of an upper yoke portion which houses a pulley wheel adapted for rotation in a vertical plane, a leg portion centered under said wheel and having means to engage an S-hook, and an opening provided between the bottom of said wheel and the top of said leg portion adapted to permit lateral displacement of a cable in a direction perpendicular to the plane of rotation of said wheel.

3. The curtain system of claim 1 wherein said carriers support adjustable length means for attachment to the upper edge of said curtain.

4. The curtain system of claim 3 wherein the horizontally oriented span of said cable has the configuration of a catenary curve, and the upper edge of said curtain is a substantially straight horizontal line.

5. The curtain system of claim 1 wherein the lower terminus of said transfer means is provided with a bifurcated downwardly opening U-shaped portion which straddles said cable, and retaining means serving to confine said cable within said bifurcated portion.

6. The curtain system of claim 1 wherein said curtain may be drawn onto the storage track which is substantially horizontally disposed to a position completely removed from said cable.

* * * * *